US007413384B2

(12) United States Patent
Horton, III et al.

(10) Patent No.: US 7,413,384 B2
(45) Date of Patent: Aug. 19, 2008

(54) FLOATING OFFSHORE DRILLING/PRODUCING STRUCTURE

(75) Inventors: Edward E. Horton, III, Houston, TX (US); James V. Maher, Houston, TX (US)

(73) Assignee: AGR Deepwater Development Systems, Inc., Houston, TX (US)

( * ) Notice: Subject to any disclaimer, the term of this patent is extended or adjusted under 35 U.S.C. 154(b) by 0 days.

(21) Appl. No.: 11/504,476

(22) Filed: Aug. 15, 2006

(65) Prior Publication Data

US 2008/0044235 A1 Feb. 21, 2008

(51) Int. Cl.
*B63B 35/44* (2006.01)

(52) U.S. Cl. ..... 405/224.2; 405/224; 405/223.1; 405/211; 114/264; 114/266

(58) Field of Classification Search ..... 405/223.1, 405/224, 224.2, 195.1, 211; 114/264, 265
See application file for complete search history.

(56) References Cited

U.S. PATENT DOCUMENTS 4,906,139 A * 3/1990 Chiu et al. ..... 405/223.1
5,558,467 A 9/1996 Horton, III
5,683,206 A * 11/1997 Copple ..... 405/224.2
6,190,089 B1 2/2001 Bennett, Jr. et al.
6,206,614 B1 3/2001 Blevins et al.
6,565,286 B2 5/2003 Carr et al.
6,575,665 B2 * 6/2003 Richter et al. ..... 405/223.1
6,652,192 B1 * 11/2003 Xu et al. ..... 405/223.1
6,761,124 B1 * 7/2004 Srinivasan ..... 114/264
6,817,309 B2 * 11/2004 Horton ..... 114/264
6,884,003 B2 4/2005 Horton, III
6,935,810 B2 8/2005 Horton, III
6,968,795 B2 11/2005 Lambregts et al.
7,063,158 B2 6/2006 Horton, III

OTHER PUBLICATIONS

Finn LD, Mahar JV, Gupta H, "The Cell Spar and VIM", Proceedings of Offshore Technology Conference, OTC 15245, Houston, TX 2003.
International Search Report and Written Opinion for PCT/US07/75891 dated May 16, 2008 (8 pages).

* cited by examiner

*Primary Examiner*—Frederick L Lagman
(74) *Attorney, Agent, or Firm*—Conley Rose, P.C.

(57) ABSTRACT

A deep draft semi submersible structure wherein the semi-submersible has a center of gravity below its center of buoyancy and the structure is a floating vessel with at least three vertically oriented buoyant columns. Each of the vertically oriented buoyant columns have at least one ballasted compartment and the columns are spaced apart at a sufficient distance to reduce vortex induced vibration amplitude. There are at least two connecting structural sealed trusses connected to the columns below sea level, they are positioned to minimize hydrodynamic wave action on the trusses and to transfer shear loads between the columns while remaining transparent to wave and ocean current motion.

20 Claims, 10 Drawing Sheets

FLOATING OFFSHORE DRILLING/PRODUCING STRUCTURE

FIELD

The present embodiments relate generally to the drilling and producing of oil offshore and more particularly to floating structures used in such operations.

BACKGROUND

In the offshore oil industry, floating structures are used in areas where deep water causes a jacket fixed to the sea floor to be too expensive to realize a sufficient economic return, even for large oil reserves. Accordingly, floating structures, such as SPAR's and semi-submersibles that are moored in place with multiple anchors, or dynamically positioned vessels are used.

Each structure has its advantages and disadvantages.

A need has existed for a vessel with a larger deck area than conventional spars.

A need has existed for a semi-submersible with improved vertical motion that can be built quickly with fewer components than other semi-submersibles.

Traditional drilling semi-submersibles require the use of seafloor Blow Out Preventers which are disconnected and retrieved to the surface prior to hurricane abandonment. The riser system is not designed to sustain the vertical motions of the semi-submersible during the hurricane. The safety and environmental implications of this system should be obvious. In deepwater, the time and complexity of the operations required to retrieve the riser prior to abandonment is significantly more important to the overall productivity of drilling operations than it had been in shallower water. Also, the complexity of the risers required to accomplish this is significantly greater. The productivity of the drilling in deepwater has been significantly adversely affected by the complexity of these operations and the economics of deepwater exploration and production development systems have been hurt by these productivity problems.

A need has existed for a semi-submersible that can be built in components in a modular manner, in one yard or in multiple yards that are at different geographic locations.

A need has existed for a semi-submersible design which has sufficiently small vertical motions that dry tree production and drilling risers can be used. The deep draft required to accomplish these small motions requires that the semi-submersible be built horizontally and float in a shallow draft of less than 40 feet.

A need has existed for a semi-submersible that is unconditionally stable.

A need has existed for a semi-submersible with sufficient emergency ballast to restore full design draft and trim.

The present embodiments meet these needs.

BRIEF DESCRIPTION OF THE DRAWINGS

The detailed description will be better understood in conjunction with the accompanying drawings as follows.

Figure 1:
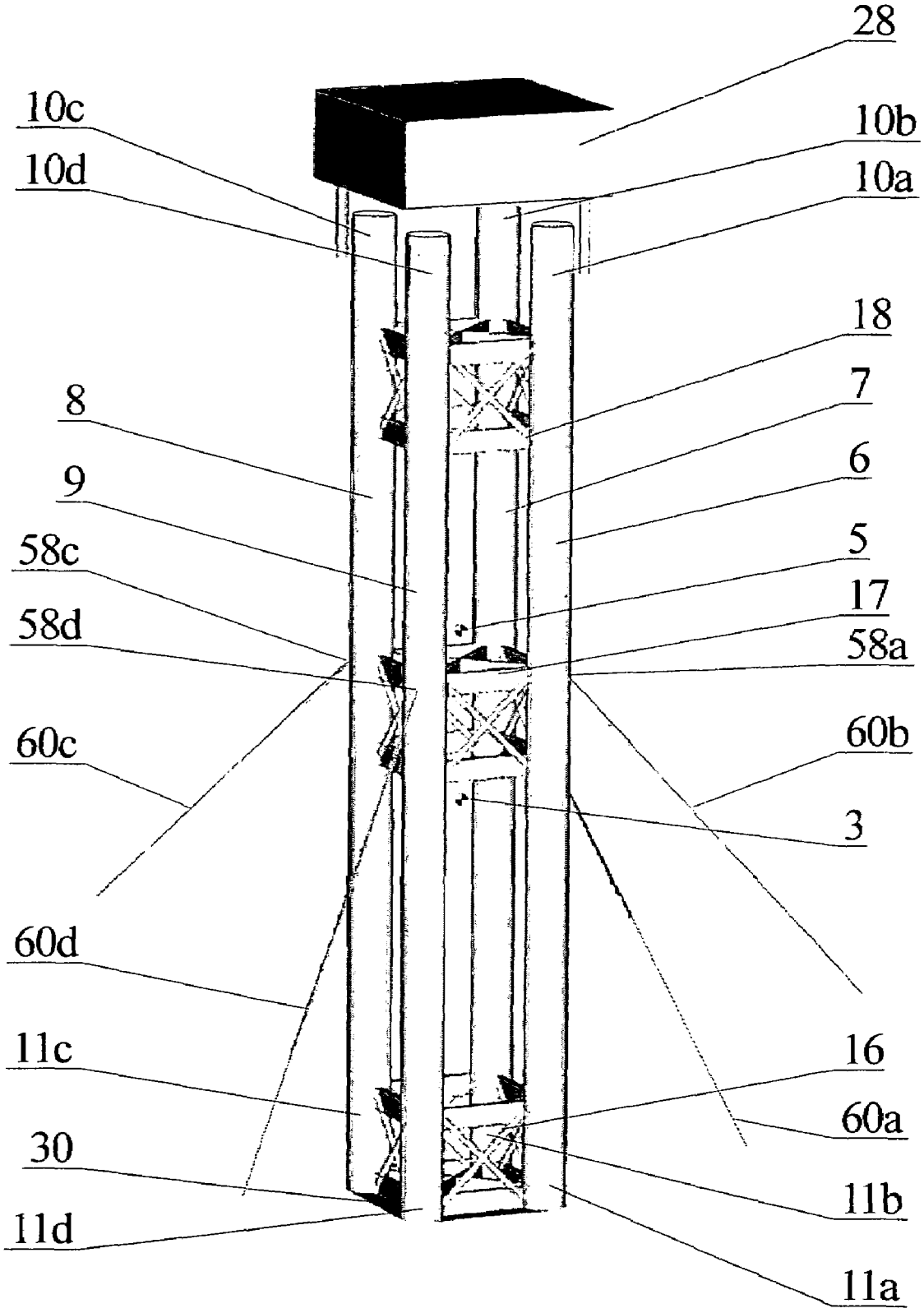
FIG. 1 depicts a perspective view of an embodiment of the semi-submersible.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that they can be practiced or carried out in various ways.

Of the two main types of structures used as oil and natural gas producing structures for deepwater fields in the Gulf of Mexico, Spars™ and Semi-submersibles, semi-submersible designs have not been traditionally able to facilitate dry trees and thus have only be used for subsea tress. The present invention provides a design of a semi-submersible that can facilitate dry trees.

Additionally, Spar™ designs with their high stability, have not been able to support larger deck areas inhibiting larger capacity drilling and production work. The present invention provides the stability of a Spar design with a large deck space of a semi-submersible that provides a functionality that meets the needs of ultra-deepwater environments.

The design is simple to construct, easy to tow to deep water, and provides a surprisingly deep draft of between 300 and 550 feet which has not be achievable as a combination of features in the past.

The present invention permits a faster, easier, and cheaper development of fossil fuel reserves in the deepwater by combining large deck areas for safe and efficient operations with the small vertical motions required to deploy the surface drilling riser systems that are more productive and safer in deepwater.

The present invention also solves some issues encountered by spars and other commercially available semi-submersibles, known as Vortex Induced Vibrations (VIV). VIV can cause problems with mooring strength design, riser fatigue and operational issues. VIV motions causes riser fatigue damage which requires more complex and higher specification riser materials and designs to be used. The present invention reduces the VIV motions and enables the use of safe, simple riser materials and designs.

The invention has another benefit over known semi-submersibles which require disconnection and retrieval of drilling risers prior to hurricane abandonment in that the surface drilling riser system deployed from this low motion vessel does not have to be disconnected in anticipation of hurricanes, enhancing drilling productivity as well as personnel and environmental safety.

The invention has another benefit over known semi-submersibles in that drilling operations through the surface drilling riser system are not sensitive to the lateral loads from the loop currents. Operations can continue through all but the largest loop current events and the riser does not need to be disconnected under any circumstances. Known semi-submersibles which deploy traditional seafloor BOPs must suspend their drilling operations when the BOP ball joint reaches a certain angle and must disconnect when the lateral loads become very high.

The present design allows more deck space than can be provided on spars, allowing more efficient deck operations, which results in lower drilling and completion costs.

The current design with its deep draft and mooring system is capable of staying on location even under extreme environmental conditions, such as a 100 year storm, while providing vertical motion stability so that top tensioned pressure drilling risers with surface BOPs and top tensional production risers can be used.

From an installation point of view, the present invention also provides significant advantages. One is the advantage of being able to decouple the operational draft from the towing draft, which enables a deep draft system independent of the draft of the channel. Another advantage is that the connecting trusses can be built with simple connections that avoid some of the typical complications with the "nodes" (or connections) between the pontoon base and columns of a typical semi-submersible. The design is capable of being built horizontally, towed in a horizontal floating condition and then upended, for receiving a floating deck, or towed with a deck attached in the horizontal position and then being upended. This enables yards with less than 50 foot depth channels to build all or a portion of the unit, which enables the building of the unit to be bid to lower bidder yards, assembled in yet a third yard, enabling the entire construction to be lower cost by allowing modular construction to occur at multiple yards. A modular semi-submersible of this type can be built faster and more economically than a unit which must all be built in one yard.

The invention, in yet another embodiment provides an improved ballast system. The column design is provided with an air over water emergency ballast system, which can provide a significant amount of additional buoyancy in the required column acting quickly to counteract the effects of an accidentally flooded compartment. This system, in combination with the unconditionally stability, provides a structure that prevents inversion, which is a common problem in known semi-submersibles. This system is thus much safer for both personnel and the environment.

This semi-submersible is also provided with the capability to self right back to the horizontal floating position, enabling simple transport to other locations.

In an embodiment, the present invention provides a semi-submersible with a deeper draft than current semi subs while providing efficient structural connections using a float over deck design.

The invention has column spacing sufficiently large in relation to the column characteristic dimension to ensure that the VIV oscillations are those caused by the individual columns rather than that of the overall circumscribed diameter. VIV oscillations occur when vortex patterns are shed at a frequency that excites the natural frequency of one of the body global motions. A horizontal current can excite translational (except for the vertical translation direction) as well as rotational oscillations. The oscillations "lock-on" when the non-dimensional parameter known as reduced velocity $$V_r = \frac{UT}{D}$$

Is within a range of values from 5 to 8. In this formula, U is the current velocity, T is the natural period of interest which typically range from 100-300 seconds (lateral translations) to 30-80 seconds (rotations), and D is the diameter. VIV is a self-limiting phenomenon and the magnitude is typically expressed in terms of the diameter, such as 0.5 A/D, which means that the amplitude of sinusoidal oscillations is equal to one half of the diameter.

Physical testing of a wide variety of similar structures has indicated that when the columns are close together, the body acts as a single large equivalent diameter, which has the effect of increasing the velocity at which the VIV oscillations begin as well as increasing the amplitude of the oscillations because the Diameter has increased. Testing has also indicated that when the columns are spaced at 1.5 D edge to edge, the VIV oscillations are characteristic of the column diameter itself, which is desirable because the oscillations are smaller even though the lock-in conditions are at lower velocities and are thus found with greater frequency.

Strakes are typically used to mitigate VIV in a wide variety of applications, including wind strakes for towers on land, marine risers, and offshore floating structures. The strake width should be between 10% to 15% of the effective column diameter in order to be effective. When the columns are separated enough for the VIV oscillations to be based on the columnar diameter rather than the combined body, the strakes can be between 10% to 13% of the column rather than of the combined body and are thus significantly simpler to fabricate. When large strakes are required, there are also significant operational and planning challenges for the fabrication and installation phases.

The hydrodynamic transparency of the truss connections are important because testing has proven that large connections that significantly affect the flow of the currents around the columns can make the structure oscillate with the overall structure diameter rather than the columnar diameter, thus rendering the strakes ineffective.

The invention also provides VIV suppression that mitigate the oscillations caused by loop current and other persistent currents found in deepwater.

The invention has hydrodynamic ally transparent connecting truss structures which reduce wave loads at the water line and eliminate the potential for large amplitude roll VIV oscillations caused by the flow blockage to the portion of the unit closest to the sea floor.

The invention is safer than other semi-submersibles because it has an improved stability mechanism with the center of buoyancy above the center of gravity, providing unconditional stability. As opposed to known semi-submersibles that have decreasing stability at large pitch and roll angles, the stability of the present invention continues increasing at large angles. A typical value for the difference between the center of buoyancy and the center of gravity can vary from 10 feet to 40 feet depending on the expected wind and under conditions similar to a 100 year hurricane.

The invention is safer than other semi-submersibles because it has an improved stability mechanism including a center of buoyancy below the center of gravity, and an improved ballast system. The column design is provided with an air over water emergency ballast system, which can provide a significant amount of additional buoyancy in the required column acting quickly to counteract the effects of an accidentally flooded compartment. This system, in combination with the unconditionally stability, provides a structure that prevents inversion, which is a common problem in known semi-submersibles. This system is thus much safer for both personnel and the environment.

The invention can support bottom tensioned risers.

The invention can also support a vertically restrained center well in yet another embodiment which provides a significant advantage over standard surface tree top tensioned risers, namely because the vertically restrained center well can support a large number of dry tree risers on a single support platform enabling the redundant buoyancy required for each riser to be shared and allowing the development of extremely high pressure wells because the high pressure manifold elements can be placed on the vertically restrained center well, avoiding the need for the high pressure flexible jumpers that would be required for high pressure applications with traditional dry tree risers. Currently the high pressure reservoirs that are under consideration are beyond the capabilities of standard flexible pipe technology.

The embodiments of the current invention saves lives by increasing the safety of the vessel well beyond the capabilities of known semi-submersibles by being unconditionally stable, by providing a superior emergency ballast system, by eliminating catastrophic failure modes that can be brought on by operator ballasting errors, by allowing the drilling personnel to evacuate at will as hurricanes approach rather than after riser pulling operations are completed.

The embodiments of the current invention saves the environment by removing the highly critical subsea BOP as well as the running operations inherent in their use, by being unconditionally stable and therefore eliminating the potential for environmental discharge associated with a capsizing event.

Now with reference to the figures, FIG. 1 shows a deep draft semi submersible structure, a floating vessel, having a center of gravity (3) below a center of buoyancy (5).

This vessel is a perspective view of an assembled semi-submersible according to the present invention. This view shows four vertically oriented buoyant columns 6,7 8,9 connected by three truss structures 16, 17, 18 with a deck 28 on the top of the assemblage and a horizontal heave plate 30 connected between the columns at the end closest to the sea floor when in the upended position. Four mooring lines, 60*a*, 60*b*, 60*c*, 60*d* are secured to a midpoint in the columns which is near a midpoint truss shown in this figure, truss 17. Each mooring line is secured to the column with a fairlead, 58*a*, 58*c*, and 58*d* are fairleads.

It should be notated that the invention contemplates a semi-submersible having only three columns or other semi-submersibles made with 5, 6, 7, 8, 9 and up to 30 columns. It is contemplated that more columns might be usable if they are smaller in diameter as well.

Each column has a top end 10*a*, 10*b*, 10*c*, 10*d* and a bottom end 11*a*, 11*b*, 11*c*, 11*d*. The bottom end extends downwardly into water toward the sea floor when in the upright and operational position.

The columns preferably all have the same shape. The shapes of the columns can be square in shape if looked at in cross section, cylindrical in shape if examined in cross section, rectangular in shape if looked at in cross section, or, triangular in shape if looked at in cross section. It is contemplated that an embodiment might have two columns each of the same shape but pairs of columns being different shapes.

Figure 2:
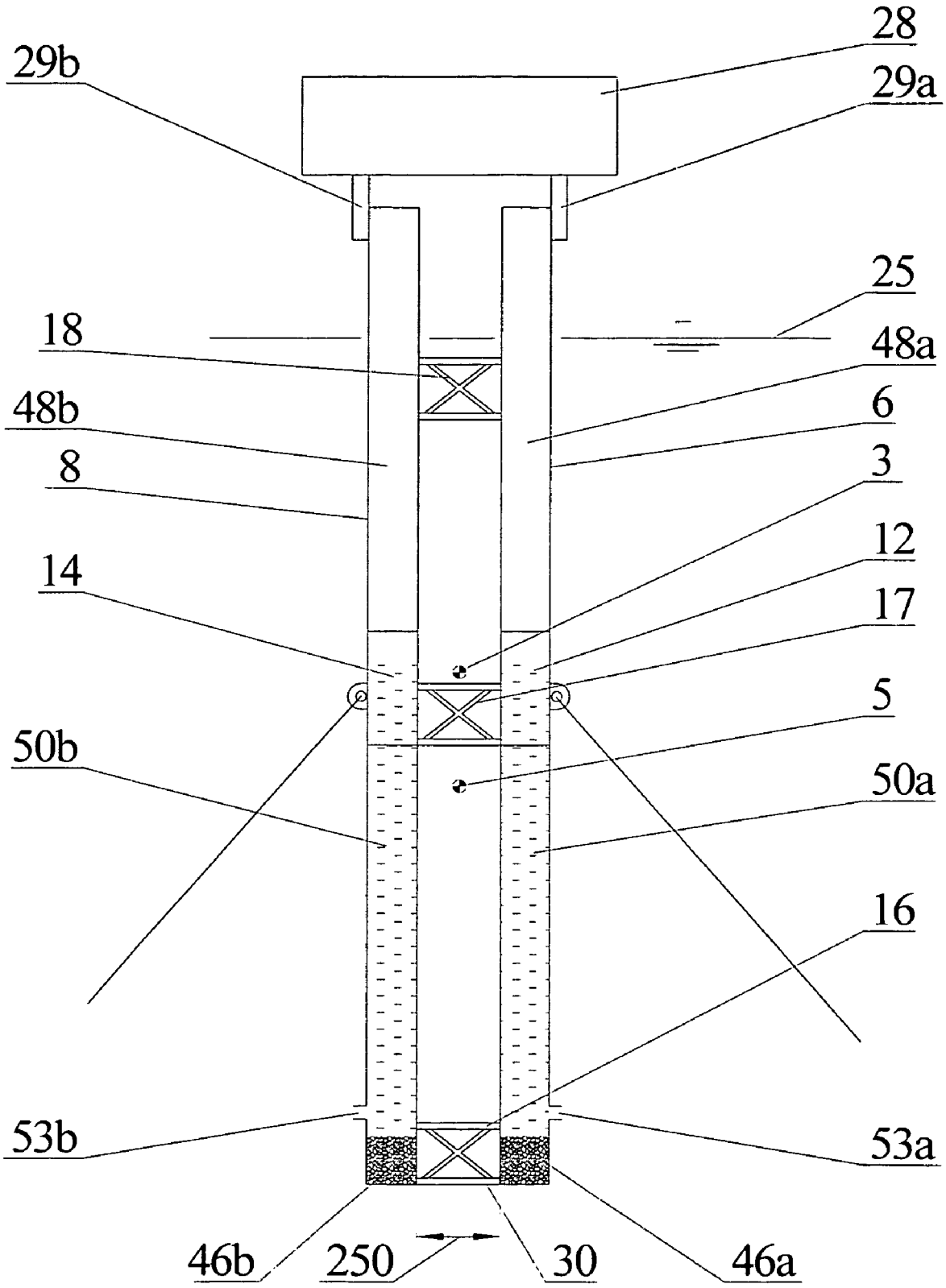
FIG. 2 is an inboard profile of an embodiment of the semi-submersible.

FIG. 2 shows that in each column, there is at least one variable ballasted compartment columns 6 and 8 are shown. This ballasted compartments are a variable ballast compartments 12 and 14 which are particularly useful during upending of the structure from a horizontal float out position after construction. The variable ballast system can be of any conventional type with preference for error-proof "over the top" ballast system where the ballasting is done by seawater from the topsides-mounted pump manifolds and depilating is done by the use of submersible pumps. Alternatively, the entire variable ballast system can be done using the same air over water mechanism as is used for the emergency ballast systems, wherein each column has one variable ballast compartment and one compartment for emergency ballast.

FIG. 2 also shows that the constructed semi-submersible is formed so that the vertically oriented columns are in a spaced apart relationship, that is having a distance 250 between the columns so that vortex induced vibration amplitude (VIV) of the assembled structure is minimized. The separation of the columns must be at least 1.5 times the diameter.

At least two connecting structural sealed trusses shown as 17 and 18 maintaining structural positioning between each pair of columns. The trusses are disposed below the water line, or sea level 25. The trusses are hydrodynamic ally transparent, meaning that the loading due to both waves and currents are significantly lower than would be the case using standard shipbuilding construction. Use of these trusses greatly reduces the overall hydrodynamic drag.

The trusses transfer shear loads between the columns which can be due to both axial buoyancy and gravity loads as well as the shear caused by the global bending moments that are caused by hurricane-induced motions and loads. Effective transfer of shear allows efficient design of the main steel in the columns.

Figure 3:
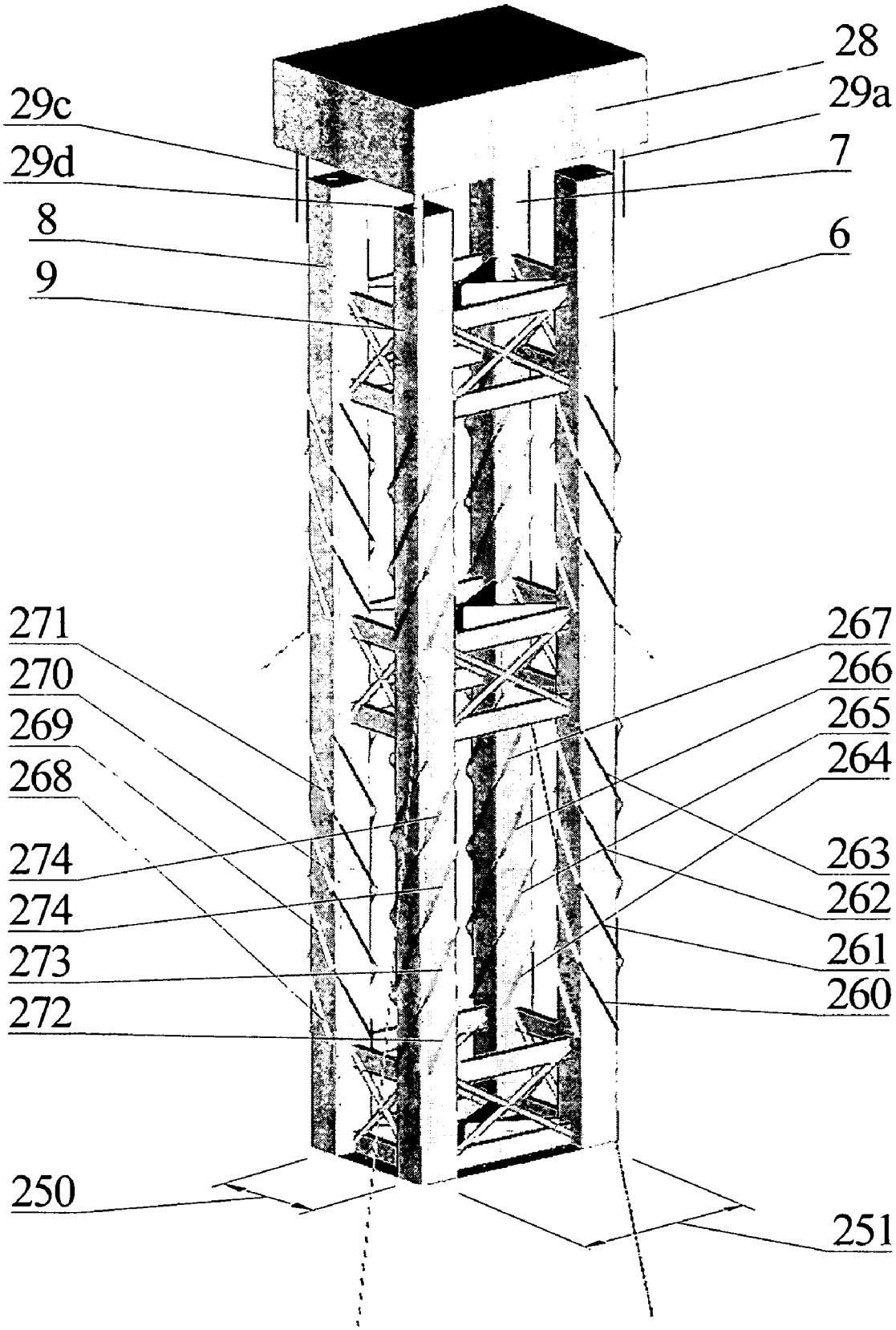
FIG. 3 is a perspective view of another embodiment of the semi-submersible.

An embodiment can provide at least one strake disposed around at least one column 6 to further minimize vortex induced vibration amplitude. It is contemplated that each column could have at least one strake. FIG. 3 shows 4 strakes per column. Namely for column 6, the strakes are 260, 261, 262, 263. For column 7 the strakes are 264, 265, 266, 267. For column 8 the strakes are 268, 269, 270 and 271. For column 9 the strakes are 272, 273, 274, and 275. It is also contemplated that each column could have 3 strakes, or one or two columns could each have multiple strakes. An exemplary strake would be one or more plates having a dimension of around 10% of the column diameter to the free edge, wrapping around the full diameter of the column at a length of between four and eight times the column diameter. On a 40' diameter column, the strake would then be 4' wide and would achieve a full 360 degree wrap between 160' and 320' below the starting elevation.

Figure 5:
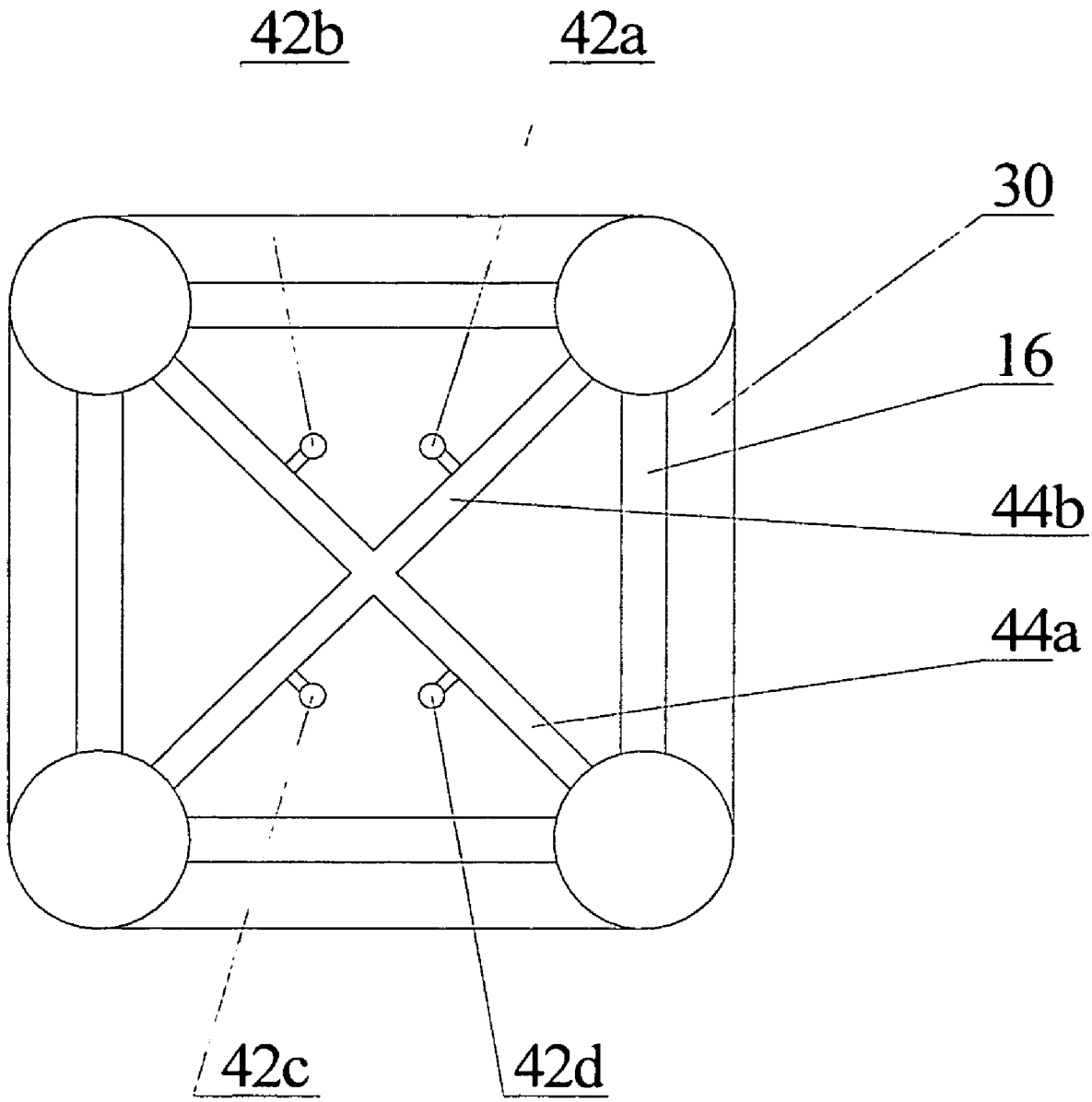
FIG. 5 is a plan view of the bottom end of the semi-submersible closest to the sea floor.

It should be noted that a plurality of risers connections are located between the columns. FIG. 5 shows a detail of four riser connections 26*a*,26*b*,26*c*,26*d*, located between the columns.

Returning to FIG. 2, the deck 28 is disposed on the columns using connecting segments for each columns, two are shown here as connecting segment 29*a* and 29*b*. At least one horizontal plate 30 is supported by the truss closest to the sea floor, shown here as truss 16. The horizontal plate serves as a heave plate and also increases mass while minimizing vertical motion of the structure while remaining transparent to current motion.

The resulting semi-submersible is a self righting, and self upending semi-submersible structure with a center of gravity 5 below a center of buoyancy 3. Additionally this structure is floatable in a horizontal position when completely assembled, because of the ballasting, and further the structure, when upended has an overall draft of between 300 and 550 feet.

This FIG. 2 also shows details of the ballasting system. Removable solid ballast 46*a*, 46*b* can be placed in each columns for repeatable upending and righting of the structure.

It should be noted that the trusses shown in FIG. 2 can be tubular members such as 30" tubular with a 1" wall thickness, and other sizes typical of offshore tubular construction or plate girders of 3'-5' high, also typical of offshore construction, or combinations thereof.

FIG. 2 additionally shows each column can have at least one hard tank 48*a* for column 6 and 48*b* for column 8. These hard tanks can be of standard construction having maximum plate thicknesses of somewhere around 1.5". The variable ballast systems can be provided in the hard tank sections. Please remove the part about control systems FIG. 2 also shows that each column can contains at least one soft tank 50*a* is shown for column 6 and 50*b* for column 8. The soft tanks are permanently flooded with sea water once upended and are thus pressure equalized while in the in-place condition. Typical plate thicknesses can thus be in the range of 0.75". The soft tank portion of each column can hold a volume of water between 50,000 $ft^3$ and 1,000,000 $ft^3$.

Additionally each column can have a flooding opening 53*a,* 53*b,* for expelling or accepting water.

Figure 4:
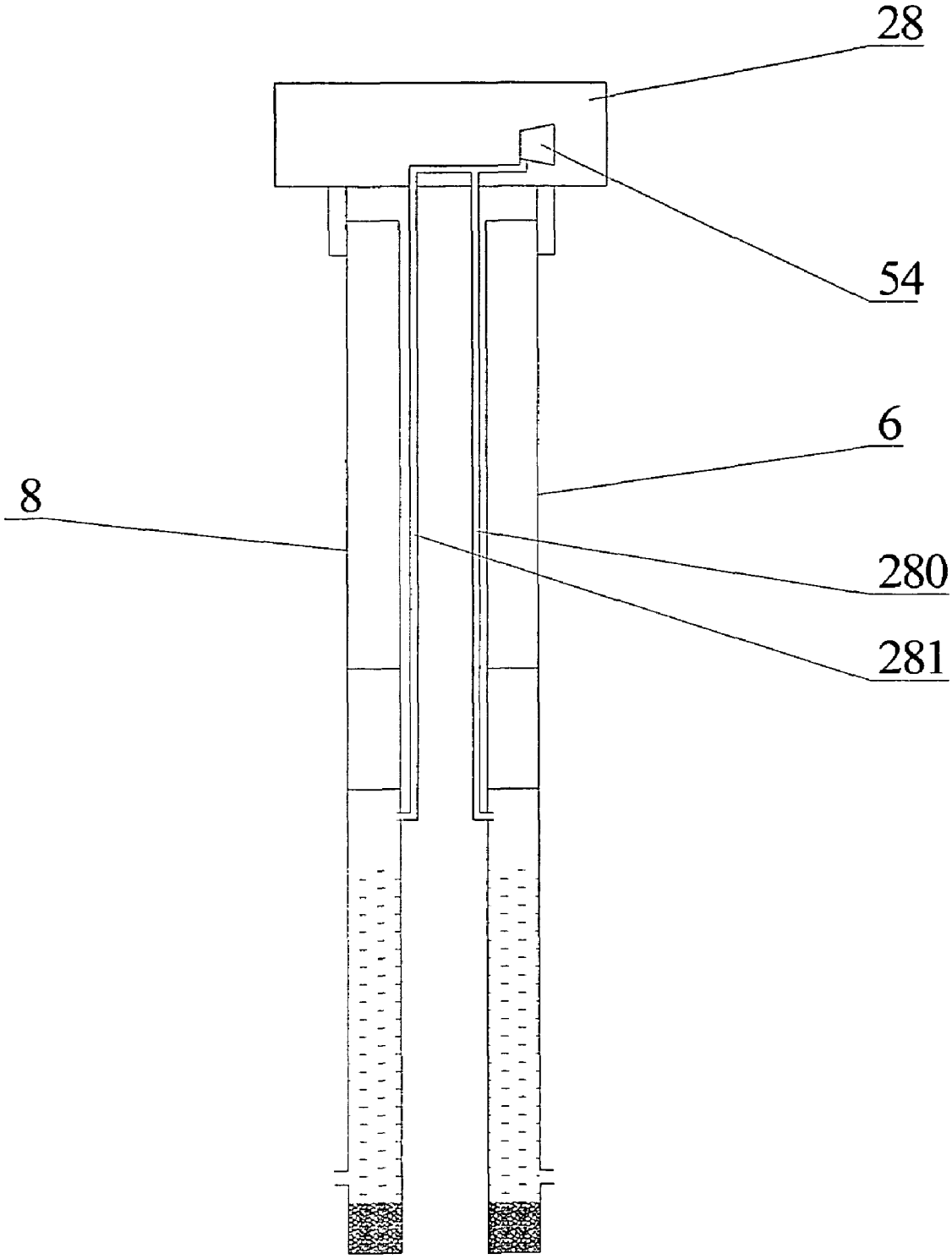
FIG. 4 is a schematic view of the air supply for the emergency air supply system of the rig.

FIG. 4 shows a schematic view of air supply for the emergency air supply system of the rig. An emergency air supply 54 connects a compressor, such as an Ingersoll Rand air compressor or a pressurized tank for expelling water from the emergency ballast tanks to right the semi submersible, through lines 280 and 281. The air supply can be in the columns or on the deck 28.

In an embodiment, the spaced apart columns can present and overall shape that is circular, rectangular, square, or triangular. Each individual column can be circular in cross section, rectangular, square or triangular 6. The columns are in a spaced apart relationship, that is edge to edge at least 1.5 times the diameter of one of the columns. The reason for this spacing is to achieve good VIV performance and simplify the strake design.

FIG. 5 shows a bottom view of a perforated horizontal plate 30 connected to the bottom truss16 and riser guides 42*a,* 42*b,* 42*c,* 42*d* for providing a lateral constraint to risers engaging the riser connections. The horizontal plate can be a plate and girder construction or a membrane construction. Membrane construction is such as that used for sails or parachutes.

FIG. 5 also shows at least one tensional brace (44*a,* 44*b*) disposed between the columns, and wherein the at least one tensional brace is transparent to hydrodynamic wave action.

Figure 6:
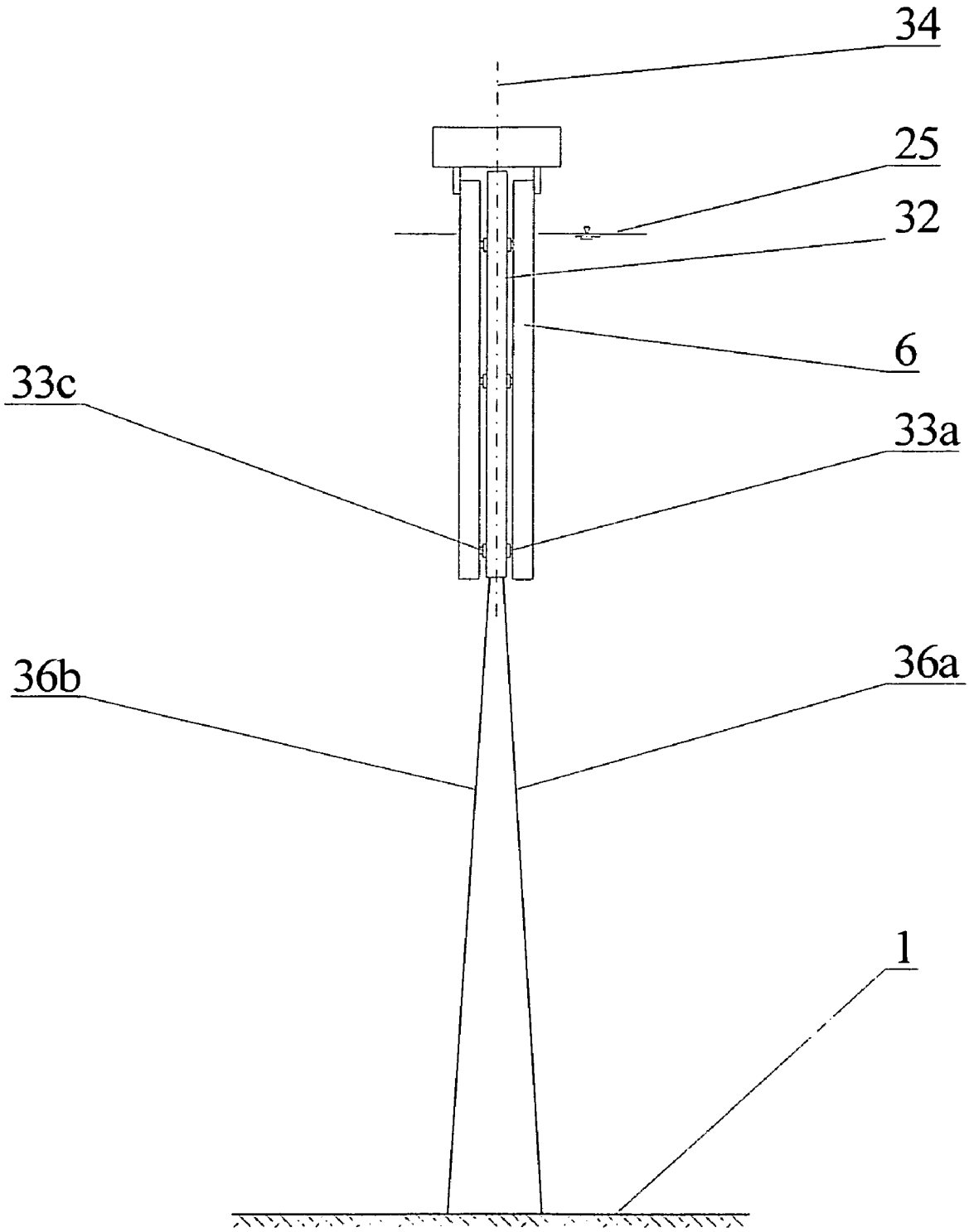
FIG. 6 is an elevation of an embodiment of the semi-submersible.

FIG. 6 demonstrates an embodiment of the semi-submersible. The semi-submersible is shown resting on the sea floor 1. The risers 36*a* and 36*b* rest on the sea floor and are connected to the oriented buoyant column 6 by means of the buoy guide 33*a.* A portion of the semi-submersible is shown protruding through the sea level 25.

Figure 7:
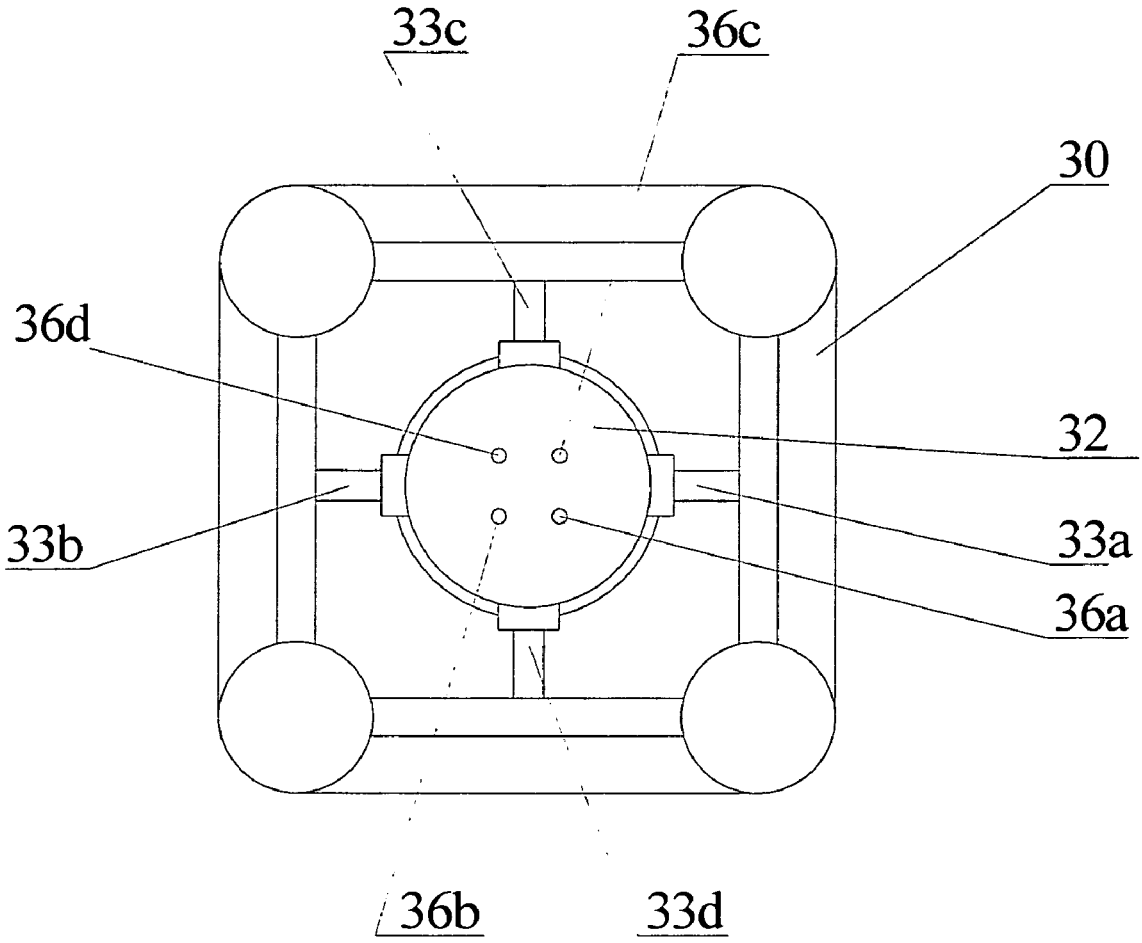
FIG. 7 is a plan view of an embodiment of the semi-submersible with a center well buoy.

FIG. 7 is a side view of an assembled semisubmersible above sea floor 1. FIG. 7 shows a center well buoy 32 disposed between the columns wherein the center well buoy has an axial centerline 34.

Figure 8:
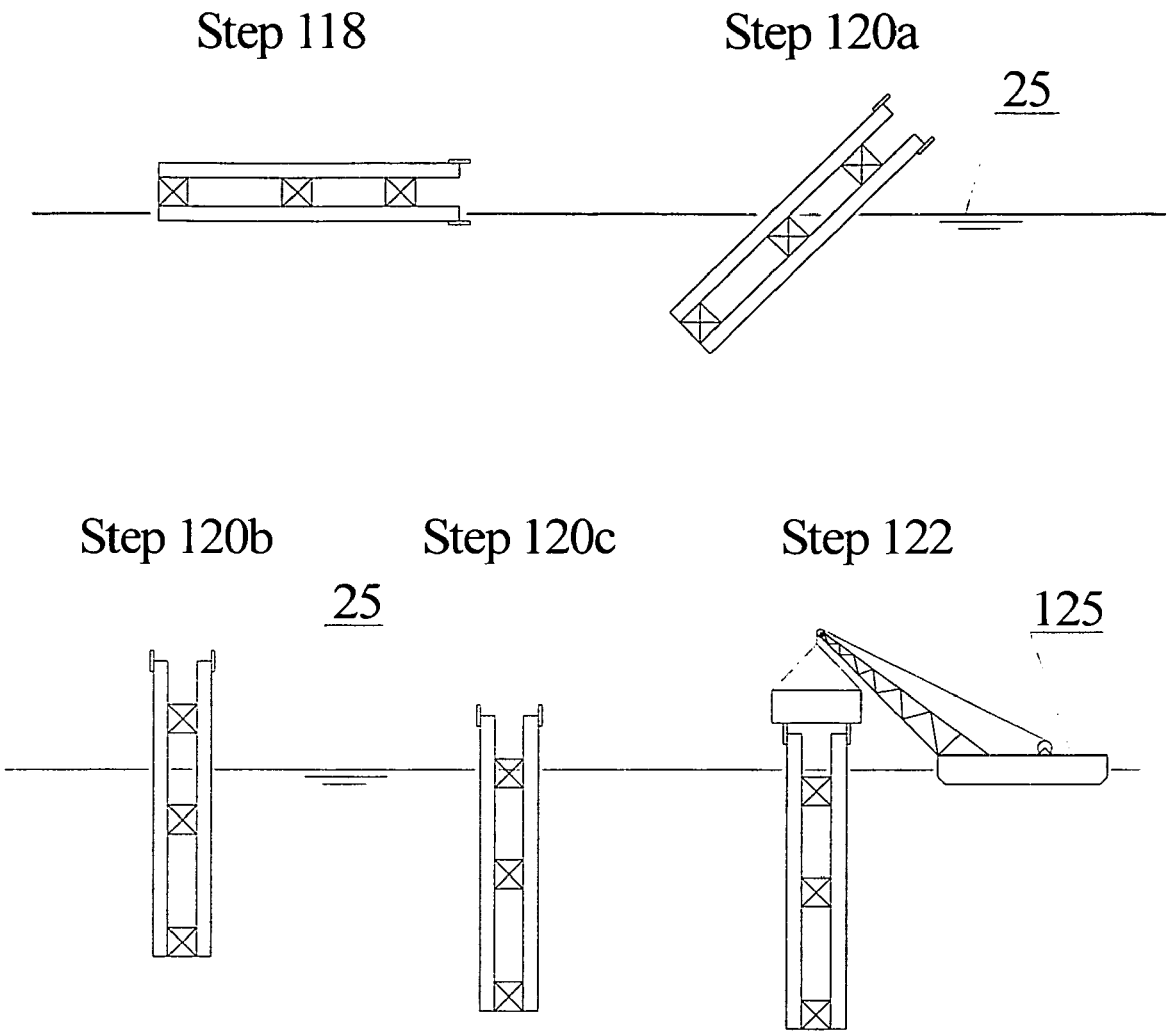
FIG. 8 is a detail of a horizontal float out and upending of an embodiment of the semi-submersible.

FIG. 8 shows multiple buoy guides 33*a,* 33*b,* 33*c,* 33*d.* This FIG. 7 also shows a plurality of risers 36*a,* 36*b,* 36*c*, and 36*d* passing through the center well buoy and extending to the sea floor. The buoy guides can be located a different positions as well, such as on the deck, on at least one column, on at least one truss, or combinations of these locations.

The riser guides provide a lateral constraint to risers engaging the riser connections.

Although the riser guides are shown in one location in FIG. 8, the riser guides can be located at different positions on the vessel, such as on the deck, disposed on at least one column, on at least one truss, or combinations of these positions.

An embodiment of the vessel contemplates that the deck used on the columns can be a float-over deck. The float over deck is connected to the columns by depilating the columns without the deck at a location for use. Then once the columns are depilated to a position below sea level, moving the float over deck over the depilated columns and connecting the float over deck to the depilated columns.

It is intended that the structure can withstand the hydrodynamic wave action wave action generated by up to a 100 year storm wave and up to a 100 year Gulf of Mexico loop current.

The heave plates are made of typical steel construction with shell plate thicknesses in the range of 0.5" to 0.75". An opening in the center can be provided for the vertically restrained center well.

Additionally, the invention relates to a method for making a semi submersible. This method contemplates that first buoyant columns are constructed, such as at one yard. Then trusses are formed, such as at another yard. The materials can then be relocated to a third yard with a dry dock. In the dry dock, or on land, the first column can be connected to a second column using at least a first top truss. A first bottom truss can then be connected to the first and second columns keeping the columns in a spaced apart relationship sufficient to reduce vortex induced vibration amplitude of the group columns when assembled.

If a dry dock is used, the connected first and second columns are then floated in water. While floating, at least a second top truss is connected to the first column floating in water and at least a second bottom truss is connected to the first column floating in water Next, at least a third top truss and third bottom truss are connected to the second column floating in water.

A third column is placed on the second top truss, and the second bottom truss such as with a crane. The third top truss and third bottom truss are connected to the third column forming a upend able, self righting semi submersible.

Referring now to FIG. 8, this assembled structure is then floated horizontally out into a channel and then towed horizontally with a shallow draft of less than 30 feet to a location for installation Step 118.

The next step 120*a* shows the start of upending the semi-submersible given sea level 101. Step 120*b* shows ballasting down with the variable ballast at a first position. Step 120*c* shows ballasting down to a second position, and step 122 shows installation of a deck using a barge and crane on the ballasted down structure. A crane vessel 125 can be used to install the deck.

In the method it is contemplated that the third column is installed in segments.

An embodiment of the method contemplates that the trusses are installed simultaneously.

Still another embodiment of the method contemplates that the deck is connected by submerging the upended semi-submersible, floating a deck over the submerged upended semi-submersible and then connecting the deck Still another embodiment of the method adds a step after installing the third top and bottom trusses, which includes installing a fourth column to the third top truss and third bottom trusses over the second column, installing a fourth top and fourth bottom truss between the third and fourth columns to form a four column semi-submersible structure.

For the four column version, it is contemplated in yet another embodiment that the third and fourth columns can be installed simultaneously.

All methods also contemplates the step of installing tensional braces between the first and third column and the second and fourth column prior to floating the semi submersible horizontally.

Still another version of the method of assembly contemplates constructing a plurality of buoyant columns; forming a plurality of trusses; connecting together a first column and a second column using at least a first top truss, connecting a first bottom truss to the first and second columns keeping the columns in a spaced apart relationship sufficient to reduce vortex induced vibration amplitude of the group columns to that of individual columns when the semi submersible is in a righted position; installing at least a second top truss to the first column; installing at least a second bottom truss to the first column; installing at least a third top truss and third bottom truss to the second column; installing a third column to the second top truss and the second bottom truss; connecting the third top truss and third bottom truss to the third column forming a partial semi submersible; floating the partial semi-submersible horizontally with a shallow draft of less than 30 feet to a location for installation, upending the partial semi-submersible; installing a deck over the upended partial semi-submersible; connecting the deck to the upended partial semi-submersible; and depilating the semi submersible with connected deck.

For this embodiment, the installations of the first, second and third top and bottom trusses to the first, second and third columns occur in a dry dock, and the dry dock is flooded prior to floating the partial semi submersible horizontally.

A version of this method contemplates that the third column is installed in segments. In this version, the trusses can be installed simultaneously.

For this version of the assembly method the deck can be connected by submerging the upended semi-submersible, floating a deck over the submerged upended semi-submersible and then connecting the deck This version contemplates still another embodiment involving a step after installing the third top and bottom trusses, installing a fourth column to the third top truss and third bottom trusses over the second column, installing a fourth top and fourth bottom truss between the third and fourth columns.

For this version, the third and fourth columns may be installed simultaneously.

Figure 9:
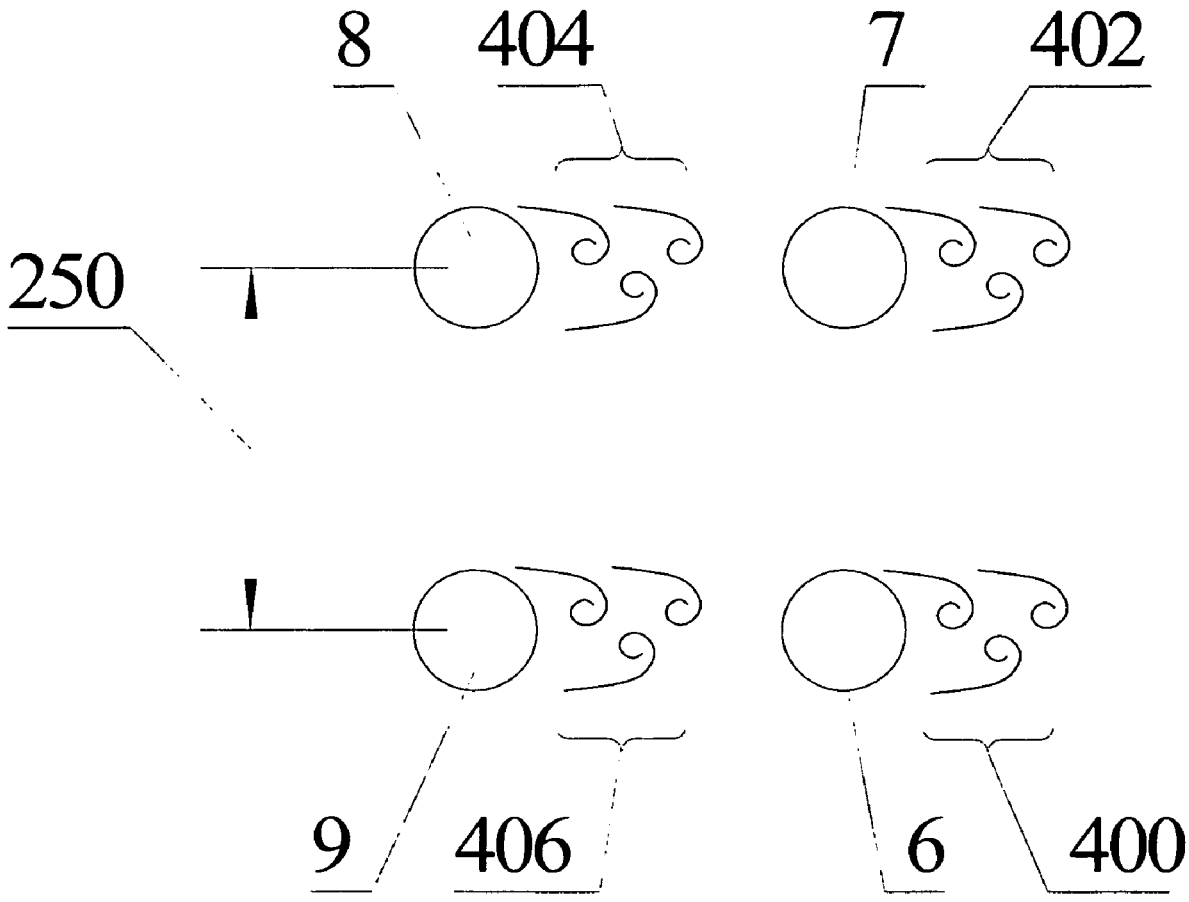
FIG. 9 shows VIV action on the individual columns of the invention.

FIG. 9 shows an embodiment of how the vortices 400, 402, 404 and 406 act on the individual columns due to the spaced apart relation, rather than the VIV acting on the entire diameter of the assembled rig. Also the spacing between the columns 250 are such so each column sheds its own vortices.

Figure 10:
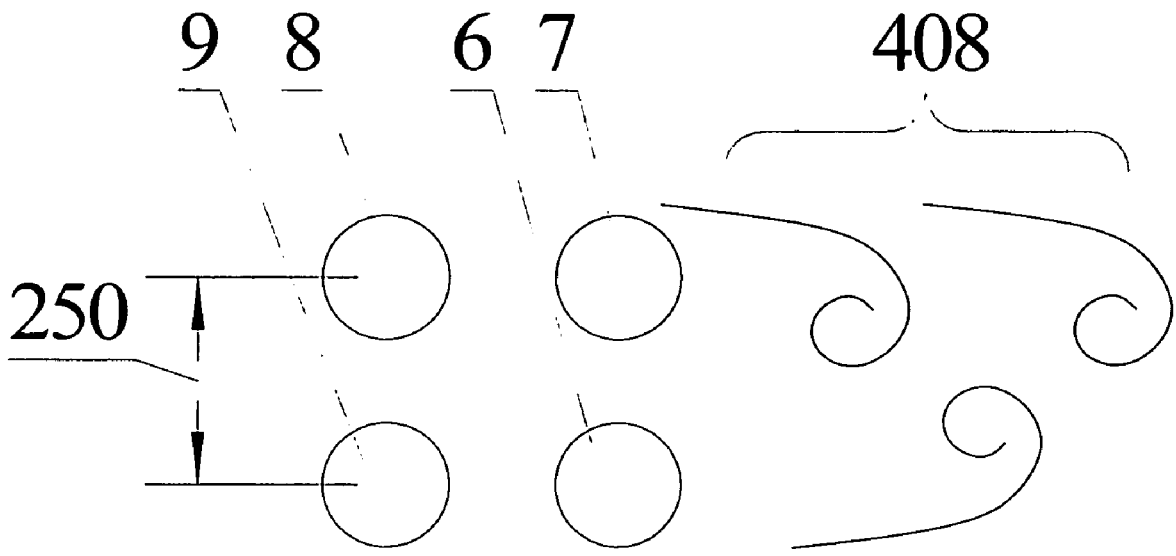
FIG. 10 shows VIV action that is undesirable due to the small spacing between the columns.

In comparison FIG. 10 shows vortices 408 action on the combined columns 6,7,8, and 9.

While these embodiments have been described with emphasis on the embodiments, it should be understood that within the scope of the appended claims, the embodiments might be practiced other than as specifically described herein.

What is claimed is:

1. A deep draft semi submersible structure having a center of gravity below a center of buoyancy comprising:

at least three vertically oriented buoyant columns having a top end and a bottom end to extend downwardly into water, each column having a shape selected from the group: square, cylindrical, rectangular, triangular, each having at least one ballasted compartment, wherein the vertically oriented columns are spaced apart a distance of at least 1.5 times a diameter of one column to reduce vortex induced vibration amplitude (VIV);

at least two connecting structural sealed trusses for maintaining structural positioning of the columns, wherein the trusses are disposed below sea level and wherein the trusses are connected to the columns to minimize hydrodynamic wave action and the trusses are adapted to transfer shear loads between the vertically oriented buoyant columns while remaining transparent to wave and ocean current motion;

at least one strake disposed around each column to further minimize vortex induced vibration amplitude, wherein the strake has a width substantially equal to 0.1 times the column diameter;

a plurality of risers connections;

a deck disposed on the columns forming a self righting, and self upending semi-submersible structure having a center of gravity below a center of buoyancy, floatable in a horizontal position when completely assembled, and having a draft between 300 and 550 feet; and at least one horizontal plate supported by a truss engaging the bottom ends of the columns for increasing mass and minimizing vertical motion of the structure.

2. The structure of claim 1, wherein the risers are located next to the columns.

3. The structure of claim 1, wherein the risers are located between the columns.

4. The structure of claim 1, wherein multiple trusses are disposed continuously throughout the columns to minimize hydrodynamic wave action and transfer shear loads.

5. The structure of claim 1, further comprising a centerwell buoy disposed between the columns wherein the centerwell buoy has an axial centerline.

6. The structure of claim 4, further comprising a plurality of buoy guides disposed on a member of the group consisting of: the columns, the trusses, or combinations thereof.

7. The structure of claim 4, wherein a plurality of risers pass through the centerwell buoy and extend to the sea floor.

8. The structure of claim 1, further comprising riser guides for providing a lateral constraint to risers engaging the riser connections.

9. The structure of claim 8, wherein the riser guides are disposed at a location selected from the group consisting of: disposed on the deck, disposed on at least one column, disposed between at least two columns, disposed on at least one truss, or combinations thereof.

10. The structure of claim 1, further comprising buoyancy can guides disposed at a location selected from the group consisting of: disposed on the deck, disposed on at least one column, disposed between at least two columns, disposed on at least one truss, or combinations thereof.

11. The structure of claim 1, further comprising at least one torsional brace disposed between the columns, and wherein the at least one torsional brace is transparent to hydrodynamic wave action.

12. The structure of claim 1, wherein the deck is a float-over deck.

13. The structure of claim 1, further comprising using removable solid ballast in the columns for repeatable upending and righting of the structure.

14. The structure of claim 1, wherein the trusses comprises tubular members, plate girders, or combinations thereof.

15. The structure of claim 1, wherein each column comprises at least one hard tank adapted for variable ballasting disposed near the top end of the column.

16. The structure of claim 1, wherein each column contains at least one soft tank.

17. The structure of claim 1, wherein the columns are in a spaced apart orientation that presents a shape selected from the group: circular, rectangular, square, or triangular.

18. The structure of claim 1, further comprising forming a recessed area below a top end of all the columns for engaging a float over deck.

19. The structure of claim 1, wherein the horizontal plate further comprises riser guides for providing a lateral constraint to risers engaging the riser connections.

20. The structure of claim 1, wherein the horizontal plate further comprises riser guides for providing a lateral constraint to risers engaging the riser connections.

* * * * *